United States Patent [19]

Broszat

[11] Patent Number: 4,510,475

[45] Date of Patent: Apr. 9, 1985

[54] DISK COIL WINDING OF INTERWOUND SINGLE OR DOUBLE COILS

[75] Inventor: Gottfried Broszat, Waiblingen-Hegnach, Fed. Rep. of Germany

[73] Assignee: Transformatoren Union Aktiengesellschaft, Stuttgart, Fed. Rep. of Germany

[21] Appl. No.: 346,880

[22] Filed: Feb. 8, 1982

[30] Foreign Application Priority Data

Feb. 13, 1981 [DE] Fed. Rep. of Germany ..... 3105317

[51] Int. Cl.[3] ..... H01F 27/08; H01F 15/14

[52] U.S. Cl. ..... 336/60; 336/70; 336/187; 336/206

[58] Field of Search ..... 336/69, 70, 186, 187, 336/60, 206

[56] References Cited

U.S. PATENT DOCUMENTS

| | | | |
|---|---|---|---|
| 2,829,354 | 4/1958 | Sealey | 336/69 |
| 3,106,690 | 10/1963 | Angermeyer | 336/70 |
| 3,246,270 | 4/1966 | Stein | 336/70 |
| 3,392,326 | 7/1968 | Lamberton | 336/70 |

FOREIGN PATENT DOCUMENTS

| | | | |
|---|---|---|---|
| 975856 | 10/1962 | Fed. Rep. of Germany . | |
| 1413549 | 1/1969 | Fed. Rep. of Germany | 336/70 |
| 2246398 | 6/1978 | Fed. Rep. of Germany | 336/70 |
| 477183 | 12/1968 | Japan | 336/70 |

*Primary Examiner*—Thomas J. Kozma

*Attorney, Agent, or Firm*—Herbert L. Lerner; Laurence A. Greenberg

[57] ABSTRACT

Disk coil winding formed of interwound single or double coils wherein insulation of outer turns opposite inner and outer generated surfaces, respectively, of the winding is reinforced in comparison with normal insulation of conductors of the winding including auxiliary insulations angularly surrounding at least one edge of at least two turns, respectively, in at least the coils disposed at an input of the winding, starting from the inner and the outer generated surface, turn capacitance between turns free of auxiliary insulation being increased with respect to turn capacitance at turns provided with the auxiliary insulations.

12 Claims, 17 Drawing Figures

DISK COIL WINDING OF INTERWOUND SINGLE OR DOUBLE COILS

The invention relates to disk coil windings of interwound single or double coils and, more particularly, to such disk coil windings wherein insulation of outer turns opposite inner and outer generated surfaces, respectively, of the windings is reinforced in comparison with normal insulation of conductors of the windings.

Simple disk coil windings exhibit a nonlinear surge voltage distribution in axial direction along the individual or single coils so that, when subjected to a loading with voltage surges, flashovers or breakdowns can occur between two adjacent coils.

It has become known heretofore from German Pat. No. 975 856 that, by interwinding the coils, a much more uniform surge voltage distribution is enforced, due to which flashovers or breakdowns are largely avoided. Exemplified embodiments of interwound disk coils are shown in cross-sectional view in FIGS. 1 and 2. FIG. 1 shows an example of two interwound single coils, and FIG. 2 an example of a pair of interwound double coils. The turns of these disk coils are traversed by a load current in the sequence of the members shown therein.

The disk coils are wound from two winding conductors, respectively, fed thereto simultaneously during a winding operation in spatially parallel relationship to one another. Thereafter, the winding conductor sections disposed within the single disk coils are serially connected electrically by being soldered together so that the turns are removed or spaced from the high-voltage terminal and, accordingly, from the point of introduction of the surge voltage pulses, in accordance with the sequence of the numbers identifying the turns. With increasing the identifying number of the turns, the voltage accordingly drops with respect to ground potential. The identifying numbers of the turns can thus also be considered as multiples of the turn voltage with respect to the winding input. The voltage drop for a single pass through a disk coil is designated as a branch voltage which occurs along the conductor. Accordingly, in a single coil winding, a single branch voltage is applied between mutually adjacent turns and, in a double coil winding, a double branch voltage between the turns. The single coil connection or circuit is therefore preferred for higher surge voltage loadings.

Regrettably, the heretofore known interwound disk coil windings also have their disadvantages, however, which reside in the increased turn loading because, instead of the single turn voltage occurring in non-interwound double coils, the single or multiple branch voltage occurs between mutually adjacent turns and, during surging actions, is a multiple of the linearly computed value. Premature discharges in or between the disk coils are thereby not excluded. The turn insulation is therefore so reinforced in interwound coils in comparison with single or simple coils, that no turn flashover or breakdown occurs, however, premature discharges at the turn edges must be taken into consideration. Part of the longitudinal or positive sequence capacitance obtained by the interwinding is thereby lost again.

Analogous to the input turns of the device according to German Pat. No. 22 46 398, which relates to a layer winding, the turns located at the inner and/or the outer generated surface of the winding is reinforcingly insulated in heretofore constructed disk coil windings for protection against premature discharge due to the occurrence of edge fields. It is disadvantageous, in the layout or construction of the reinforced insulation, from this standpoint, however, that either the longitudinal capacitance is again reduced or that a weak point occurs in the insulation due to cumulative effect of the branch voltage between the two fully inner or fully outer adjacent turns in one disk coil with the branch voltage with respect to other disk coils. Thus, predischarges are indeed prevented at the coil edge but not, however, between the turns.

This results from the problematic nature of the longitudinal strength of interwound coil windings. Due to the interwinding, the surge voltage difference between two adjacent coils is reduced to such an extent that no flashover or breakdown occurs therebetween, for totally reinforced conductor insulations in comparison with non-interwound coils. If the voltage is further increased, however, a longitudinal flashover or breakdown occurs over several coils ahead of the flashover or breakdown between two adjacent turns or coils.

The reason for such longitudinal flashovers or breakdowns has been the subject of controversy heretofore. According to a predominant opinion, the oil field strength at the outer edges of both marginal turns of a disk coil as compared to other coils is assumed to be the cause of such discharges. For this reason, these turns were reinforcingly insulated analogously to the arrangement according to the German Pat. No. 22 46 398 or the winding-conductor insulation reinforced by edge-protective angles. In spite of these measures, longitudinal flashovers or breakdowns initially occurred along the outer generated surface to a coil located farther removed from the input, when the test voltage has been increased beyond the rated voltage. This is also not prevented by the edge-protective angles.

It is accordingly an object of the invention to provide a disk coil winding of interwound single or double coils with a reinforcement of the conductor insulation, taking economy or efficiency into consideration and while maintaining the high longitudinal capacitance attained by the interwinding, so that predischarges both between mutually adjacent turns as well as between different disk coils, for the provided test voltages, are precluded.

The inventive solution for this objective is based on the assumption that the high field strength between adjacent turns provides a contribution towards the cause of the longitudinal flashover or breakdown, if the voltage between the two radially farthest inner or outer turns of a disk coil is superimposed in the same direction on the axially extending voltage along several of the disk coils. This is especially the case at the inner and outer marginal regions on the disk coils. The voltage from turn to turn, in the radially middle region of the single disk coils, does not increase monotonically but rather alternatingly towards and away, so that no transverse flashovers or breakdowns occur thereat. It is therefore possible to provide weaker or less conductor insulation in this region.

With the foregoing and other objects in view, there is provided, in accordance with the invention, a disk coil winding formed of interwound single or double coils wherein insulation of outer turns opposite inner and outer generated surfaces, respectively, of the winding is reinforced in comparison with normal insulation of conductors of the winding comprising auxiliary insulations angularly surrounding at least one edge of at least two turns, respectively, in at least the coils disposed at an input of the winding, starting from the inner and the outer generated surface, turn capacitance between turn free of auxiliary insulation being increased with respect to turn capacitance at turns provided with the auxiliary insulations. For reasons of simplifying manufacture, more than two, and especially all, of the turns of the coils lying at the winding input can be formed with auxiliary insulation, the thickness of which reduces to zero at the coils farther removed from the input.

In accordance with another feature of the invention, there is provided a respective axial cooling channel, in addition to a respective auxiliary insulation, disposed between a respective turn located at the inner and the outer generated surface, respectively, and a respective adjacent turn.

In accordance with a further feature of the invention, the auxiliary insulation comprises paper tape surrounding the turns on all sides and formed of U-shaped or angular pressed board coverings.

In accordance with an additional feature of the invention, the auxiliary insulations for the turns located at the inner generated surface of the winding are reduced in size successively at lower outer, lower inner and upper inner locations, and for the adjacent turn reduced successively towards lower inner and upper inner locations, lower representing in direction towards earth potential and upper representing in direction towards high-voltage input.

In accordance with an added feature of the invention, the auxiliary insulations for the turns located at the outer generated surface of the winding are reduced in size successively at upper inner, upper outer and lower inner locations, and for the adjacent turn reduced successively towards upper outer and lower outer locations, lower representing in direction towards earth potential and upper representing in direction towards high-voltage input.

In accordance with yet another feature of the invention, the turns located at the inner generated surface of the winding are sheathed with an additional insulation angle at the lower outer edge thereof, and the respective adjacent turn with an additional insulation angle at the lower inner edge thereof, and the remaining turns are insulated like the turns in a middle part of the disk coil.

In accordance with an auxiliary feature of the invention, the middle turns in the single or individual disk coils have a common paper wrapping. This paper wrapping prevents predischarge in the oil channel between two coils if predischarges have been prevented in the marginal conductor wedges.

In accordance with yet a further feature of the invention, the auxiliary insulations and/or the additional axial cooling channels are located at least in vicinity of the high-voltage input of the coils, and the auxiliary insulations have a thickness decreasing with increasing distance thereof from the high-voltage input of the winding.

The disk coil arrangement according to the invention is very advantageously applicable for interwound disk coils because it considerably improves the dielectric strength in the winding unit without significantly reducing the longitudinal or positive-sequence capacitance obtained by the interwinding. In spite of the better space factor through the winding construction according to the invention, the withstand pulse voltage of the coil winding is increased by increasing the longitudinal strength thereof. Thereby, the assembly of an economical winding for higher voltages as compared with conventional types of construction is feasible. Moreover, through the arrangement of auxiliary axial cooling channels, the higher heating in the thicker insulated marginal turns is again compensated. A complete compensation for the higher heating in the marginal turns of the inventive device is possible, if necessary, by a slight reinforcement of the cross sections thereof, whereby then the $I^2R$ losses reduce very greatly with R as the eddy-current losses increase. Other features which are considered as characteristic for the invention are set forth in the appended claims.

Although the invention is illustrated and described herein as embodied in a disk coil winding from interwound single or double coils, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
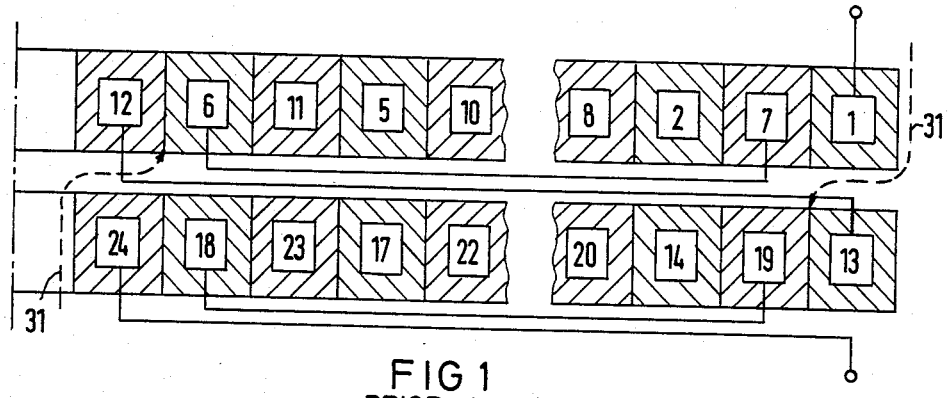
FIG 1 PRIOR ART
FIG. 1 is a diagrammatic cross-sectional view of two separate interwound coils.
Figure 9:
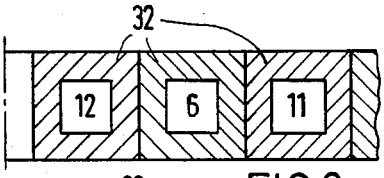
Figure 10:
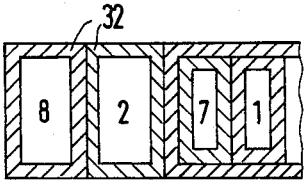
Figure 11:
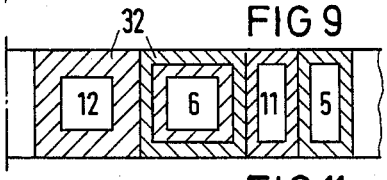
Figure 12:
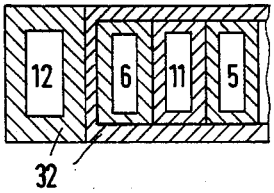
Figure 13:
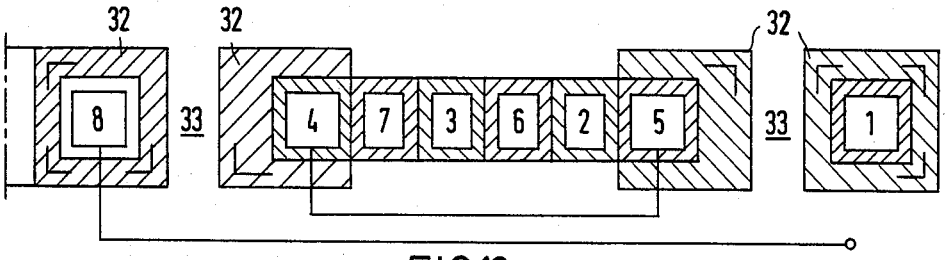

FIGS. 4 through 12 are views similar to that of FIG. 1 of a respective single coil having varying forms of auxiliary insulation according to the invention, there being indicated in FIG. 9 that not only the minimally required two boundary turns, respectively, but rather all turns of the input coils are provided with auxiliary insulation 32, and only the standard coils distant from the input coils are provided without any insulation 32. With standard input coils under sequentially decreasing voltage loads down to zero the supplemental insulation 32 can be reduced accordingly, which makes a more economical layout feasible; and FIGS. 13 through 17 show a single coil each having supplemental insulation according to the invention with supplemental axial cooling channels.

Mutually corresponding parts are identified in all of the figures by like reference characters.

Conventional, so-called interwound disk coils are wound of two simultaneously and spatially parallel-fed winding conductors having turns 1 to n traversed by load current in the sequence of the indicated numbers. A multiple of the turn voltage is applied, respectively, across two adjacent turns. To determine this voltage, the respective difference of the numbers in the turns under consideration is multiplied by the single turn voltage to obtain therefrom the voltage difference between adjacent conductors which, under linear distribution conditions, is assumed to be an alternating-voltage difference, this voltage difference being boosted by a multiple of the linear component during a surge voltage. The insulation throughout the winding conductors is dimensioned for this voltage difference.

Figure 2:
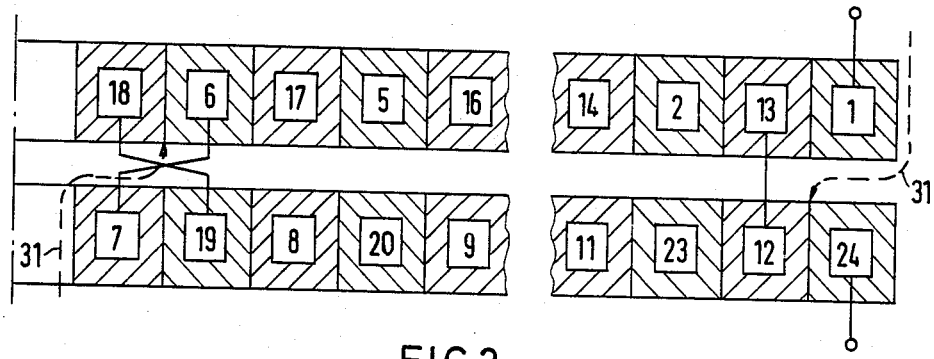
FIG 2 PRIOR ART
FIG. 2 is a view similar to that of FIG. 1 of a pair of interwound double coils.
Figure 3:
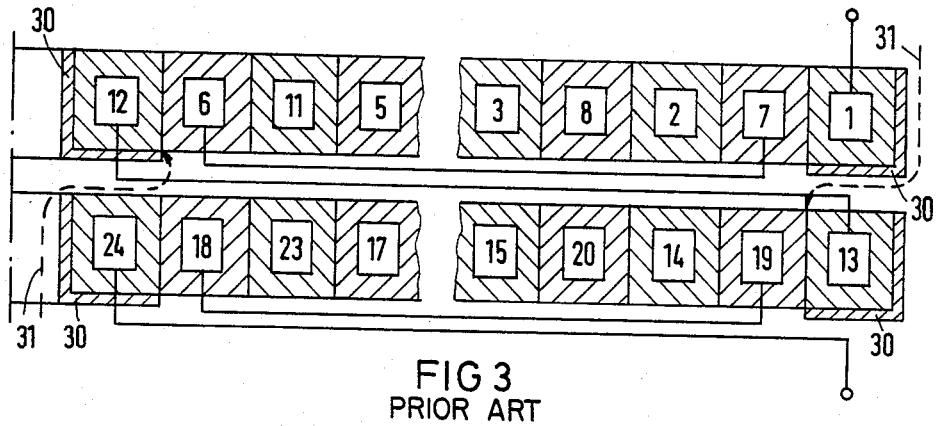
FIG 3 PRIOR ART
FIG. 3 is another view similar to that of FIG. 1 of two separate coils according to FIG. 1 with insulation by angle rings.
Figure 4:
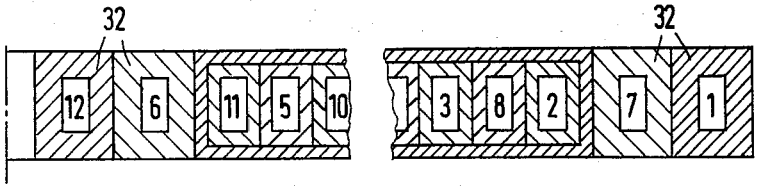
Figure 5:
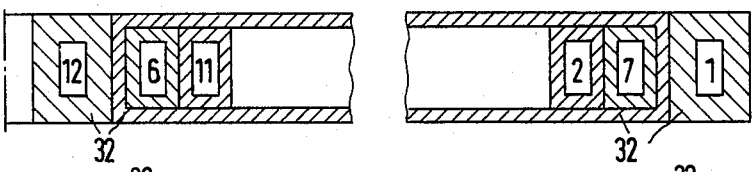

To improve the dielectric strength and, simultaneously, to provide mechanical protection of the winding, respective angle rings 30, as shown in FIG. 3, have been disposed heretofore on the innermost and outermost turn of each individual disk coil. Even with this arrangement, flash-overs are frequently observed along the broken lines 31 (see FIGS. 1 to 3) when there is a voltage rise. A multiplicity of the inner lines 31 run from the illustrated uppermost input coil to the innermost adjacent conductor gap (wedge) of a coil located at a distance of four or more coils away. The outer lines 31 extend, however, from the non-illustrated outer turn of the uppermost input coil to the outermost adjacent conductor gap (wedge) of a lower illustrated coil, which is spaced four or more coils away from the input coil.

In this regard, the high field strength at the junction between two marginal adjacent conductors of the input coils is considered to be the cause of initial predischarges.

The invention is based upon the idea that such predischarges run their course from these "critical oil wedges", which are formed at the adjacent edge or margin of the conductor gap, along the line 31 i.e. in radial direction to the generated surface of the coil, and then in axial direction along this generated surface or vice versa because, starting only from these critical wedges in both directions, the voltage applied to the line 31 decreases or increases monotonically and, thus, always lengths of the lines 31 occur at which the permissible resistance to slippage or sliding is exceeded so that longitudinal flash-over occurs along the line 31.

But the lengths and voltages can be less effectively varied and, thus, the resistance to slippage or sliding associated therewith increased less than to eliminate the predischarges in the critical wedges as the cause of slippage or sliding by reducing thereat the oil field strengths. This reduction is effected by means or measures taken in accordance with the invention.

The permissible resistance to slippage or sliding of the line 31 is understood to be the experimentally determined surge voltage applied to a length 31 and yet, in fact, not yet leading to a flash-over along the line 31, if at one end of the line 31, predischarges are initiated as a result of high oil field strengths.

To harden the disk-coil arrangement, a supplemental or auxiliary insulation 32 is provided, in accordance with the invention, at least on both innermost and outermost turns in each disk coil near to the input whereby, for simpler production, for all turns of these input coils, the thickness of the supplemental or auxiliary insulation 32 may be reduced to zero for standard coils, with decreasing voltage to ground.

The effect of these supplemental or auxiliary insulations 32 on exemplified embodiments according to FIGS. 13 to 17 is reinforced by a respective axial cooling channel each at the hereinaforementioned junctions so that the critical conductor wedges are completely avoided.

Figure 14:
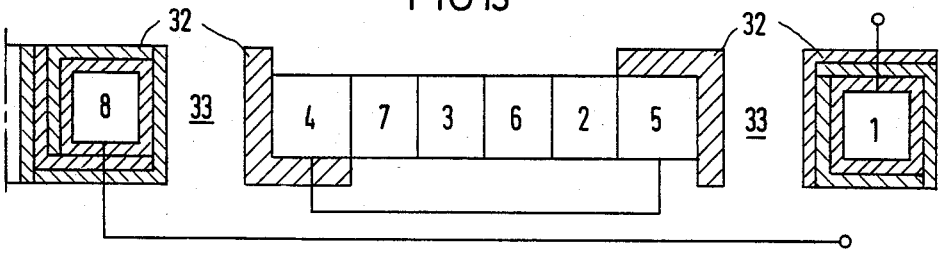
Figure 15:
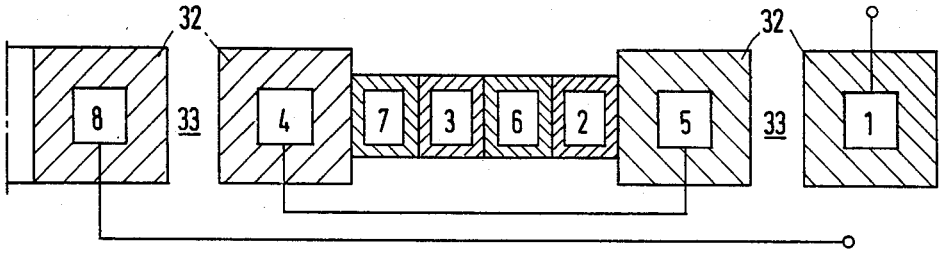
Figure 16:
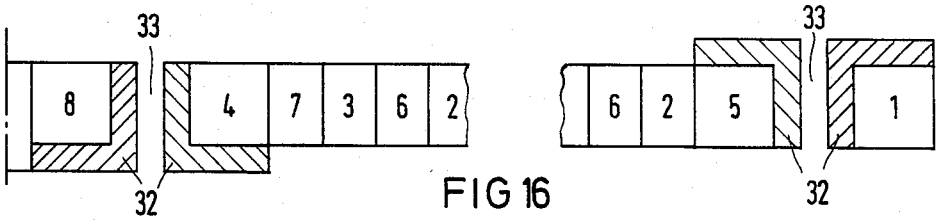
Figure 17:
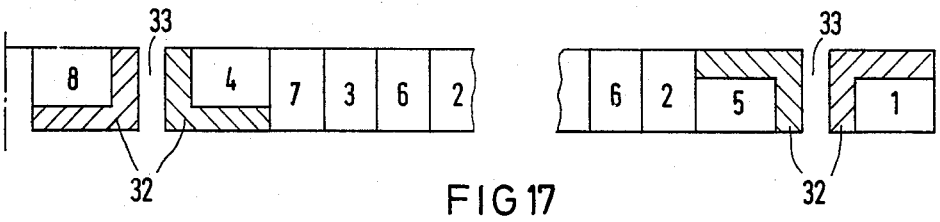

In view of the actually occurring voltage load, it is sufficient of itself to reinforce the insulation used with all the input coils on both outermost and innermost turns, respectively, of each disk coil only at the outer upper and inner lower side thereof. Exemplified embodiments thereof are shown in FIGS. 14, 16 and 17. In contradistinction thereto, in the embodiment according to FIG. 15, the insulation of the turns therein is reinforced equally on all sides. These solutions are relatively expensive and difficult to monitor, however, yet they optimally utilize the available winding space.

Figure 6:
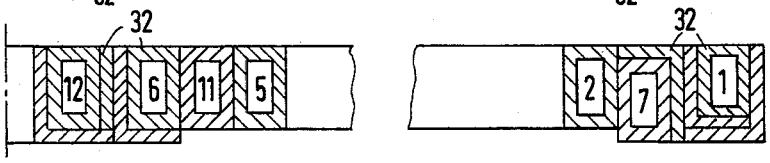
Figure 7:
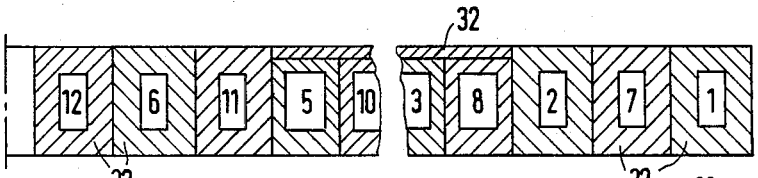
Figure 8:
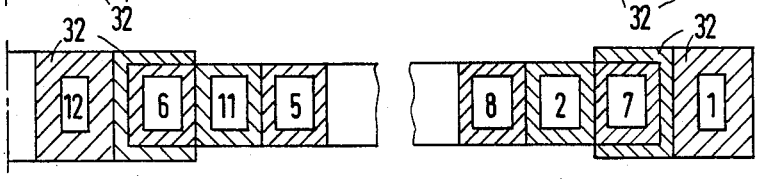

In the arrangements according to FIGS. 6, 16, and 17, the supplemental or auxiliary insulations 32 are represented by simple corner angles, and in the embodiment according to FIG. 14, the innermost and the outermost turn of the disk coil are surrounded by several corner protective angles staggered in accordance with the decreasing field strength.

To avoid any constrictions of the radial cooling channels, insulator parts set off from the disk coils in axial direction are dispensed with in the exemplified embodiments according to FIGS. 4, 5, 7, 9, 10, 11, 12 and 17 wherein, for example, the marginal or edge turns are provided with such a modified turn cross-section that the axial height including the supplemental or auxiliary insulation 32 is equal to the standard or normal height of a normal turn. In the exemplified embodiments according to FIGS. 4 and 5, this is represented by a common wrapping of the central turns of the disk coil.

The embodiments illustrated in FIGS. 4 to 17 exemplify interwound single coils according to FIG. 1 but apply also, in accordance with the invention, to interwound double coils according to FIG. 2. In FIGS. 4 to 17, with the exception of FIG. 9, only both inner and outer marginal or edge turns have supplemental or auxiliary insulations 32. Of course, other possible embodiments according to the invention are conceivable wherein all of the turns of the coils located at the winding input are provided with the supplemental or auxiliary insulation so that, by using an all-around reinforced turn insulation 32, they look like the embodiments of FIGS. 1, 2, and 9, and so that only those coils distant from the input are constructed with turns having no auxiliary or supplemental insulation.

The foregoing is a description corresponding to German Application P 31 05 317.3, dated Feb. 13, 1981, International priority of which is being claimed for the instant application, and which is hereby made part of this application. Any discrepancies between the foregoing specification and the aforementioned corresponding German application are to be resolved in favor of the latter.

There is claimed:

1. Disk coil winding comprising interwound disk coils formed of conductor turns having normal insulation thereon, the spacing of only two outermost and only two innermost turns of at least one disk coil being greater than the spacing between turns in the remainder of said at least one disk coil, auxiliary insulations only on said two outermost and two innermost turns angularly surrounding one edge and providing greater insulation thickness than the normal insulation on said turns in the remainder of said at least one disk coil, said at least one disk coil the disposed at an input of the winding, starting from inner and outer generated surfaces, turn capacitance between turns free of auxiliary insulation being increased with respect to turn capacitance at turns provided with said auxiliary insulations.

2. Disk coil winding according to claim 1 comprising a respective axial cooling channel disposed between said innermost turns and said outermost turns.

3. Disk coil winding according to claim 1 wherein said auxiliary insulations are comprised of paper tape surrounding the turns on all sides and formed of pressed board coverings.

4. Disk coil winding according to claim 3 wherein the pressed board coverings are U-shaped.

5. Disk coil windings according to claim 3 wherein the pressed board coverings are angular.

6. Disk coil winding according to claim 1 wherein the auxiliary insulations for the turns located at the inner generated surface of the winding are reduced in size successively at lower outer, lower inner and upper inner locations, and for the adjacent turn reduced successively towards lower inner and upper inner locations, lower representing in direction towards earth potential and upper representing in direction towards high-voltage input.

7. Disk coil winding according to claim 1 wherein the auxiliary insulations for the turns located at the outer generated surface of the winding are reduced in size successively at upper inner, upper outer and lower inner locations, and for the adjacent turn reduced successively towards upper outer and lower outer locations, lower representing in direction towards earth potential and upper representing in direction towards high-voltage input.

8. Disk coil winding according to claim 1 wherein the turns located at the inner generated surface of the winding are sheathed with an additional insulation angle at the lower outer edge thereof, and the respective adjacent turn with an additional insulation angle at the lower inner edge thereof.

9. Disk coil winding according to claim 1 wherein said auxiliary insulations are located at least in vicinity of the high-voltage input of the coils, and said auxiliary insulations have a thickness decreasing with increasing distance thereof from the high-voltage input of the winding.

10. Disk coil winding according to claim 2 wherein said axial cooling channels are located at least in vicinity of the high-voltage input of the coils, and said auxiliary insulations have a thickness decreasing with increasing distance thereof from the high voltage input of the winding.

11. Disk coil winding according to claim 2 wherein said auxiliary insulations and said axial cooling channels are located at least in vicinity of the high-voltage input of the coils, and said auxiliary insulations have a thickness decreasing with increasing distance thereof from the high-voltage input of the winding.

12. Disk coil winding according to claim 1 wherein turns in said remainder of said at least one disk coil are middle turns having a common paper wrapping.

* * * * *